US011273350B2

(12) United States Patent
Chappell et al.

(10) Patent No.: US 11,273,350 B2
(45) Date of Patent: Mar. 15, 2022

(54) GOLF SYSTEM

(71) Applicant: Henry Chappell, Croyde (GB)

(72) Inventors: Henry Chappell, Croyde (GB); Daniel Pickard, Dronfield (GB)

(73) Assignee: Henry Chappell, Croyde (GB)

( * ) Notice: Subject to any disclaimer, the term of this patent is extended or adjusted under 35 U.S.C. 154(b) by 0 days.

(21) Appl. No.: 16/563,059

(22) Filed: Sep. 6, 2019

(65) Prior Publication Data

US 2021/0060398 A1 Mar. 4, 2021

(30) Foreign Application Priority Data

Sep. 3, 2019 (GB) ..... 1912652

(51) Int. Cl.
*A63B 67/02* (2006.01)
*A63B 57/40* (2015.01)

(52) U.S. Cl.
CPC ..... *A63B 67/02* (2013.01); *A63B 57/40* (2015.10); *A63B 2067/025* (2013.01)

(58) Field of Classification Search
CPC ... A63B 57/40; A63B 67/02–2067/025; A63B 69/3694
USPC ..... 473/150
See application file for complete search history.

(56) References Cited

U.S. PATENT DOCUMENTS 4,171,134 A 10/1979 Reck
4,900,023 A * 2/1990 Gelina ..... A63B 57/357 473/179
5,087,045 A 2/1992 Kim
5,133,557 A 7/1992 Sugimoto
5,401,027 A 3/1995 Surbeck
5,524,891 A * 6/1996 Owen, Jr. ..... A63B 57/357 473/196
5,776,004 A 7/1998 Wilson
6,338,682 B1 1/2002 Torchia et al.
9,108,097 B1 8/2015 Rhone
9,821,220 B2 * 11/2017 Gupta ..... A63F 13/213
9,993,712 B2 * 6/2018 Coffman ..... A63B 69/3661
2002/0128084 A1 9/2002 Lee et al.
2003/0190969 A1 10/2003 Barlow et al.
2004/0198524 A1 10/2004 Kwon
2004/0204258 A1 10/2004 Hanoun
2007/0037629 A1 * 2/2007 Neal ..... A63B 67/02 473/157

(Continued)

FOREIGN PATENT DOCUMENTS

CN 108721865 11/2018
DE 20 2015 105 117 U1 12/2015

(Continued)

OTHER PUBLICATIONS

Great Britain Search Report dated Mar. 4, 2020 issued in Great Britain Patent Application No. 1912652.3, 5 pp.

(Continued)

*Primary Examiner* — Laura Davison
(74) *Attorney, Agent, or Firm* — Nixon & Vanderhye P.C.

(57) ABSTRACT

A golf system comprising a reconfigurable golf green having a hole for receiving a golf ball, wherein the reconfigurable golf green includes a plurality of movable golf green sections (e.g. wherein the movable golf green sections are provided in a reconfigurable array).

19 Claims, 12 Drawing Sheets

(56) References Cited

U.S. PATENT DOCUMENTS

| | | | | |
|---|---|---|---|---|
| 2015/0087433 | A1* | 3/2015 | Roberts | A63B 69/3661 473/195 |
| 2015/0231479 | A1 | 8/2015 | Coffman | |
| 2016/0306036 | A1 | 10/2016 | Johnson | |

FOREIGN PATENT DOCUMENTS

| | | | | |
|---|---|---|---|---|
| EP | 1 872 835 | | 1/2008 | |
| GB | 1181401 | A * | 2/1970 | A63B 69/3661 |
| KR | 10-0912011 | | 8/2009 | |
| KR | 20-2010-0003080 | | 3/2010 | |
| KR | 10-2017-0046292 | | 5/2017 | |
| WO | WO 01/12275 | | 2/2001 | |
| WO | WO 2007/011964 | | 1/2007 | |

OTHER PUBLICATIONS

Partial International Search Report dated Dec. 11, 2020 issued in PCT International Patent Application No. PCT/GB2020/052109, 14 pp.

* cited by examiner

GOLF SYSTEM

CROSS-REFERENCES TO RELATED APPLICATIONS

This application claims the benefit of Great Britain Patent Application No. 1912652.3, filed Sep. 3, 2019, the entire content of which is hereby incorporated by reference in this application.

FIELD

The present invention relates to a golf system including a reconfigurable golf green having a hole for receiving a golf ball. The invention also relates to a reconfigurable hole for a golf system. The invention also relates to a ball game system including a reconfigurable surface having a hole intended for receiving a ball.

BACKGROUND

Golf is a game which involves hitting a golf ball from a tee position towards a hole for receiving the golf ball. Typically, the hole is defined in a golf green, and the player begins hitting the golf ball from a tee position located at a distance from the hole/golf green. The aim of the game is to hit the golf ball into the hole in as few shots as possible.

A typical golf course includes a plurality of 'holes' (i.e. a plurality of: holes for receiving a golf ball; golf greens; tee positions; and fairways linking the golf greens to the tee positions). For example, there are 18 'holes' in a standard golf course. For this reason, golf courses typically occupy a large area (e.g. around 150 acres or 600,000 square metres).

During a 'round' of golf (i.e. 18 'holes'), players may walk long distances around the golf course (e.g. 5 to 10 km per round). Spectators can watch a game of golf by moving around the golf course so that they can see the players and/or hole in use.

The present teachings seek to overcome or at least mitigate one or more problems associated with the prior art.

SUMMARY

According to a first aspect of the invention, a golf system is provided, the golf system comprising a reconfigurable golf green having a hole for receiving a golf ball. The reconfigurable golf green includes a plurality of movable golf green sections (e.g. the movable golf green sections are provided in a reconfigurable array).

Put another way, the invention provides a ball game system comprising a reconfigurable surface having a hole intended for receiving a ball, wherein the reconfigurable surface includes a plurality of moveable sections (e.g. wherein the movable sections are provided in a reconfigurable array).

Such a golf system (or ball game system) allows a variety of different golf green configurations (or surface configurations) using a single green area (or reconfigurable surface). This contrasts with a typical golf course which requires landscaping of the 18 different 'holes' in order to provide a range of playing surface configurations.

Due to the large size of a standard 18-hole golf course, it typically takes a long time to play a 'round' (i.e. 18 'holes') of golf, since players are required to walk long distances around the course (e.g. 5 to 10 km per round). In addition, spectators can only see a small area of a traditional golf course from a single position. Therefore, if watching a full round of traditional golf, there is a need for spectators to travel around the golf course with the players. For this reason, there are typically no seats for golf spectators. The need to stand and move around for long periods of time may prohibit certain groups of people from watching live golf (e.g. wheelchair users).

The large size of a standard golf course also results in a high purchasing/building cost, particularly in areas where land is limited and expensive, such as large cities. These costs are passed on to the players of the golf course, which can result in a high cost to play a round of golf.

The golf system (or ball game system) of the present invention overcomes these challenges by providing a range of configurations of a single golf green (or reconfigurable surface), which allows multiple rounds of golf (or ball games) to be played in a smaller area.

Furthermore, the golf system (or ball game system) has environmental benefits over a traditional golf course, since it facilities a smaller sized golf course (or reconfigurable surface) which allows: irrigation requirements to be reduced (if using a natural turf layer on top of the sections of the golf green) or eliminated (if using an artificial turf layer); minimal landscaping disturbance to install; and minimal ongoing maintenance and green keeping. This may also result in a lower cost to play golf (or ball games) on a golf system (or ball game system) of the present invention, than on a traditional golf course.

In exemplary embodiments, the golf system is configured so that each golf green section is movable, in order to change the size or shape of a playable area of the golf green (e.g. each golf green section is movable between a playable state and a non-playable state).

In this way, the size and or shape of the playable area of the golf green may be altered via movement of the golf green sections. This allows a single golf green area to be used for multiple rounds or 'holes' of golf, with a different configuration of the golf green used for each round. This may be beneficial in golf environments where space is limited (e.g. in inner city golf courses, or in a golf stadium where spectators can watch the game from a single position).

In exemplary embodiments, the plurality of movable golf green sections defines a series of concentric rings relative to the hole.

In exemplary embodiments, the golf system is configured to raise or lower the concentric rings to alter the diameter of the playable area of the golf green.

In other words, the diameter of the playable area may be reduced via lowering the outermost concentric ring(s) from a playable state to a non-playable state, and the diameter of the playable area may be increased via raising one or more concentric rings from the non-playable state to the playable state.

Altering the diameter of the playable area, alters the difficulty of landing a golf ball on the golf green. This allows the diameter to be reduced when a player is hitting from a relatively close tee position or the diameter to be increased when a player is hitting from a relatively distant tee position.

In addition, this allows the difficulty to be altered for players of different abilities. For example, the diameter could be reduced for a more experienced player, or increased for a less experienced player.

In some embodiments, the concentric rings are comprised of a plurality of arc-shaped segments. In some embodiments, the golf system is configured to move the segments transversely towards or away from the hole to alter the diameter of the playable area of the golf green.

In exemplary embodiments, the golf system further comprises a vessel configured to be filled with a liquid in use, so that an upper surface of each concentric ring is above a surface of the liquid when it is raised and below the surface of the liquid when it is lowered.

In other words, each concentric ring transitions from a playable state to a non-playable state via being submerged in the liquid held by the vessel.

Advantageously, by submerging concentric rings in their non-playable state, it is clear that they do not form part of the playable area from any viewing angle (e.g. even from a plan view).

In exemplary embodiments, the hole is a reconfigurable hole.

In exemplary embodiments, the reconfigurable hole comprises: a cylindrical bore having an upper end; one or more coaxial rings located within said bore; and an adjustable aperture at said upper end. In exemplary embodiments, the reconfigurable hole is configured to alter the diameter of said adjustable aperture via raising one or more coaxial rings to the upper end of the bore, or lowering one or more coaxial rings into the bore away from the upper end.

In other words, the diameter of the adjustable aperture is increased via lowering the outermost coaxial ring(s) into the cylindrical bore away from the upper surface, and the diameter of the adjustable aperture is decreased via raising one or more coaxial rings to the upper end of the bore.

Altering the diameter of the adjustable aperture, alters the difficulty of hitting a golf ball through the adjustable aperture. This allows the diameter to be reduced when a player is hitting from a relatively close tee position, or the diameter to be increased when a player is hitting from a relatively distant tee position.

In addition, this allows the difficulty to be altered for players of different abilities. For example, the diameter could be reduced for a more experienced player, or increased for a less experienced player.

In exemplary embodiments, the golf system comprises a tee position located for striking a ball in the direction of the hole.

In exemplary embodiments, the golf system comprises a plurality of tee positions located for striking a ball in the direction of the hole, wherein the plurality of tee positions are distributed at different distances from the hole.

In exemplary embodiments, the golf system is configured to alter the diameter of the playable area of said reconfigurable golf green depending on the distance between the hole and the tee position being used.

In other words, as a player moves to a tee position closer to the hole, the diameter of the playable area is decreased by lowering one or more concentric rings of the reconfigurable golf green.

In exemplary embodiments, the golf system is configured to alter the diameter of the adjustable aperture of said reconfigurable hole depending on the distance between the hole and the tee position being used.

In other words, as a player moves to a tee position closer to the hole, the diameter of the adjustable aperture of the reconfigurable hole is decreased via raising one or more coaxial rings of the reconfigurable hole to the upper end of the cylindrical bore.

In exemplary embodiments, the plurality of movable golf green sections each comprise an upper surface, wherein the golf system is configured such that when two or more movable golf green sections are positioned adjacent each other, the upper surfaces of said two or more movable golf green sections are flush.

In other words, the movable golf green sections form a substantially planar playing area with no gaps, or a part thereof.

Advantageously, this provides a smooth surface which allows a golf ball to roll over without getting stuck between the movable golf green sections.

In exemplary embodiments, the interface between adjacent concentric rings and/or the interface between an inner of the concentric rings and a centre of the golf green comprises an overlapping arrangement.

By overlapping the edges of the concentric rings, a flush surface is provided.

In exemplary embodiments, the overlapping arrangement comprises a downwards-facing chamfered edge on a radially inner side of the interface and an upwards-facing chamfered edge on a radially outer side of the interface.

This overlapping arrangement has been found to provide a flush interface. Furthermore, this arrangement helps to self-centre the concentric rings, which further prevents gaps from forming.

In exemplary embodiments, each concentric ring comprises one or more linear guide rods extending downwards therefrom, wherein the golf system further comprises one or more corresponding bosses configured to receive the one or more linear guide rods.

In this way, rotation, horizontal movement and tilting of the concentric rings is prevented, whilst allowing linear vertical movement. By preventing tilting of the concentric rings, the chance of gaps forming in the playable area (e.g. between concentric rings) is reduced.

By preventing rotation, any markings on the upper surface of multiple concentric rings (e.g. distance markings or advertising markings) do not become misaligned.

In exemplary embodiments, the interface between adjacent concentric rings and/or the interface between an inner of the concentric rings and a centre of the golf green comprises: a radially inner side having a guide channel or a guide block; and a radially outer side having a corresponding guide block or guide channel; wherein the guide block is arranged to move upwards and downwards through the guide channel.

In this way, linear vertical movement between the concentric rings and/or the centre of the golf green is permitted, but relative rotation between them is prevented. By preventing rotation, any markings on the upper surface of multiple concentric rings (e.g. distance markings or advertising markings) do not become misaligned.

In exemplary embodiments, each concentric ring comprises one or more hydraulic cylinders, wherein the golf system is configured to raise or lower said concentric ring via extending or retracting the one or more hydraulic cylinders.

Hydraulic cylinders provide a reliable means of moving an object in a linear direction, and are therefore suitable for this application.

In exemplary embodiments, each concentric ring comprises a plurality of circumferentially distributed hydraulic cylinders.

By distributing multiple hydraulic cylinders around the concentric rings, the loads caused by the weight of the rings and any objects or people located thereon are distributed evenly around the circumference of the ring. This helps to reduce the tendency for the concentric rings to tilt, and reduces torsional or rotational pressure on the hydraulic cylinders.

In exemplary embodiments, each concentric ring is buoyant, such that, when raised in use, the load from the one or more hydraulic cylinders is complemented by an upwards pressure from the water or other suitable liquid in the vessel.

In this way, a uniformly distributed load is produced, which prevents the ring-shaped moveable section from deflecting and altering the planar nature of the playable area.

In exemplary embodiments, the one or more hydraulic cylinders are oil based. In some embodiments, the one or more hydraulic cylinders are water based.

In some embodiments, each concentric ring comprises one or more variable buoyancy devices, wherein the golf system is configured to raise or lower said concentric ring via altering the buoyancy of the one or more variable buoyancy devices.

Advantageously, the use of variable buoyancy devices provides a simple system for moving the concentric rings with no moving parts. This provides easy installation and maintenance.

In exemplary embodiments, the golf system further comprises one or more pumps configured to supply air or other buoyant substance to one or more variable buoyancy devices.

In exemplary embodiments, each variable buoyancy device comprises an inlet for receiving air or other buoyant substance from the pump.

In other words, the buoyancy of the variable buoyancy device is increased by pumping air or other buoyant substance into the variable buoyancy device through the inlet.

In exemplary embodiments, each variable buoyancy device comprises an outlet for purging air or other buoyant substance from the variable buoyancy device.

In other words, the buoyancy of the variable buoyancy device is decreased via opening the outlet which allows water or other liquid from the vessel to enter the variable buoyancy device and air or other buoyant substance to flow out of the variable buoyancy device.

In this way, the inlet and the pump do not need to be arranged for two-way flow, since air can be purged from the outlet to the surrounding water or other liquid in the vessel.

In exemplary embodiments, the golf system further comprises at least one valve between the one or more pumps and the variable buoyancy devices.

Advantageously, this provides an easy arrangement for controlling the flow of air or other buoyant substance to the variable buoyancy devices.

In exemplary embodiments, each concentric ring comprises a plurality of circumferentially distributed variable buoyancy devices.

By distributing multiple variable buoyancy devices around the concentric rings, the loads caused by the weight of the rings and any objects or people located thereon is distributed evenly around the circumference of the ring. This helps to reduce the tendency for the concentric rings to tilt.

In exemplary embodiments, each concentric ring comprises a height and levelling control mechanism configured to limit the extent to which it may be raised.

In exemplary embodiments, the height and levelling control mechanism comprises a plurality of chains or like anchors connected to said concentric ring and said vessel.

In this way, the variable buoyancy devices may be limited to raise slightly below the surface of the water or other liquid in the vessel so that the concentric rings do not move with ripples or waves on the surface of the water or other liquid.

In exemplary embodiments, said plurality of chains or like anchors are distributed circumferentially around said concentric ring.

By distributing multiple chains or like anchors around the concentric rings, the height is limited around the circumference of the rings, which helps to reduce the tendency for the concentric rings to tilt.

In exemplary embodiments, each chain or like anchor is connected to a receiving arrangement on said concentric ring, wherein the receiving arrangement comprises an adjustment mechanism for altering the length of the chain or like anchor.

This provides a mechanism for adjusting and fine tuning the height/level of each concentric ring during commissioning or maintenance activities.

In exemplary embodiments, the receiving arrangement comprises a cavity in the concentric ring, and a removable plate arranged to cover the cavity.

Advantageously, this provides a means of accessing the receiving arrangement for adjusting the length of the chain or like anchor from above (by removing the cover plate) whilst maintaining a flush surface under normal operation (by covering the cavity with the cover plate).

In exemplary embodiments, the adjustment mechanism comprises an adjustment screw or bolt located in the cylindrical cavity.

Advantageously, a screw or bolt can easily be adjusted via a hand tool such as a screwdriver, wrench or allen key.

In exemplary embodiments, the variable buoyancy devices are sized such that, when filled with air or other buoyant substance in use, a weight greater than the weight of the concentric rings may be supported by said variable buoyancy devices.

In this way, maintenance staff, players or other objects may be located on the concentric rings without causing significant vertical movement of said concentric rings.

In some embodiments, each concentric ring comprises one or more rotary cam mechanisms, wherein the golf system is configured to raise or lower said concentric ring via rotation of the one or more rotary cam mechanisms.

In some embodiments, each concentric ring comprises one or more winches, wherein the golf system is configured to raise or lower said concentric ring via rotation of the one or more winches.

In some embodiments, each concentric ring comprises one or more rack and pinion devices, wherein the golf system is configured to raise or lower said concentric ring via rotation of the pinions of the one or more rack and pinion devices.

In exemplary embodiments, each movable golf green section is a multilayer component comprising: a permeable upper surface; a wire mesh located below the upper surface and configured to support the upper surface; and a support frame located below the wire mesh and configured to support the wire mesh and upper surface.

By having a wire mesh supporting a permeable upper surface, water or other liquid does not pool on the surface of the moveable golf green sections. This is particularly beneficial for golf systems including concentric rings which transition between a playable state and an unplayable state submerged under water or other liquid.

In exemplary embodiments, the thickness of each multilayer component is in the range of 50 mm to 400 mm, preferably in the range of 150 mm to 250 mm, more preferably substantially 200 mm.

In exemplary embodiments, the support frame is made of a strong and lightweight material, preferably aluminium.

By having a lightweight support frame, relatively small sized actuators (e.g. hydraulic cylinders and/or variable buoyancy devices and/or winches and/or rotary cam mechanisms and/or rack and pinion devices) can be used.

In exemplary embodiments, the upper surface comprises a layer of turf or artificial turf.

Advantageously, this type of surface is readily available since it is commonly used for golf and other ball games. In addition, the properties of friction between a golf ball and a turf or artificial turf layer are well-known, which makes it suitable for defining the playable area of the golf system.

In exemplary embodiments, each moveable golf green section comprises a plurality of segments, wherein each segment comprises a connection arrangement for engagement with the connection arrangement of another segment.

Advantageously, this arrangement allows the golf system to be dismantled, transported and reassembled (e.g. if part of a touring event).

In exemplary embodiments, each connection arrangement comprises a quick-release connection.

Advantageously, this reduces the time required to assemble or dismantle the golf system.

In exemplary embodiments, the golf system further comprises a golf ball tracking system configured to detect the position of a golf ball on the golf green.

In this way, the position of a golf ball relative to the hole can be detected. This may be beneficial for golf games which assign a points-based score depending on the proximity of a golf ball to the hole.

In some embodiments, the golf ball tracking system comprises one or more cameras configured to face the golf green.

Cameras have been widely used for ball tracking in a variety of sports. Therefore, this may provide a cheap and simple means of tracking a golf ball. In addition, using cameras does not require any modifications to the golf green itself.

In some embodiments, the golf ball tracking system comprises one or more sensors located within the golf green.

This may offer a quicker means for accurately determining the position of a golf ball than other systems (e.g. camera-based systems which require a small delay due to image processing).

According to a second aspect of the invention a reconfigurable golf hole for receiving a golf ball is provided, the reconfigurable hole comprising: a cylindrical bore having an upper end; one or more coaxial rings located within said bore; and an adjustable aperture at said upper end. In exemplary embodiments, the reconfigurable hole is configured to alter the diameter of said adjustable aperture via raising one or more coaxial rings to the upper end of the bore, or lowering one or more coaxial rings into the bore away from the upper end.

In other words, the diameter of the adjustable aperture is area is increased via lowering the outermost coaxial ring(s) into the cylindrical bore away from the upper surface, and the diameter of the adjustable aperture is decreased via raising one or more coaxial rings to the upper end of the bore.

Altering the diameter of the adjustable aperture, alters the difficulty of hitting a golf ball through the adjustable aperture. This allows the diameter to be reduced when a player is hitting from a relatively close tee position, or the diameter to be increased when a player is hitting from a relatively distant tee position.

In addition, this allows the difficulty to be altered for players of different abilities. For example, the diameter could be reduced for a more experienced player, or increased for a less experienced player.

In exemplary embodiments, the reconfigurable hole further comprises one or more linear actuators provided to control the position of the one or more coaxial rings within the bore.

Advantageously, linear actuators provide a means of accurately controlling the position of the coaxial rings. Furthermore, suitable linear actuators are relatively cheap and readily available.

In exemplary embodiments, the reconfigurable hole comprises a pole receiving formation configured to receive a flag pole.

Advantageously, this allows the hole to be marked by a flag, which allows the position of the hole to be identified from a greater distance.

According to a third aspect of the invention, a golf system is provided, the golf system comprising: a reconfigurable golf green, wherein the reconfigurable golf green includes a plurality of movable golf green sections defining a series of concentric rings relative to the hole and wherein the golf system is configured to raise or lower the concentric rings to alter the diameter of the playable area; a reconfigurable hole provided in the reconfigurable golf green, wherein the reconfigurable hole comprises: a cylindrical bore having an upper end; one or more coaxial rings located within said bore; and an adjustable aperture at said upper end; wherein the reconfigurable hole is configured to alter the diameter of said adjustable aperture via raising one or more coaxial rings to the upper end of the bore, or lowering one or more coaxial rings into the bore away from the upper end; and a plurality of tee positions located for striking a ball in the direction of the reconfigurable hole, wherein the plurality of tee positions are distributed at different distances from the reconfigurable hole. In exemplary embodiments, the golf system is configured to simultaneously alter the diameter of said playable area and the diameter of said adjustable aperture, depending on the distance between the reconfigurable hole and the tee position being used.

In other words, as a player moves to a tee position closer to the hole, the diameter of the playing area and the adjustable aperture is decreased by lowering one or more concentric rings of the reconfigurable golf green and raising one or more coaxial rings of the reconfigurable hole to the upper end of the cylindrical bore.

In this way, the difficulty of hitting a golf ball into the adjustable aperture may remain substantially equal, regardless of the distance between the tee position and the reconfigurable hole.

According to a fourth aspect of the invention, a golf system is provided, the golf system comprising a reconfigurable golf green having a hole for receiving a golf ball, wherein the size and or shape of a playable area of the golf green can be automatically altered via changing the appearance of one or more sections of the golf green.

Advantageously, changing the appearance of one or more golf green sections may offer a quicker mechanism for reconfiguring the playable area of the golf green than by moving sections of the golf green. This may also provide other opportunities such displaying adverts on the playable area during breaks.

In exemplary embodiments, the golf system further comprises one or more internal lighting devices, wherein the appearance of said one or more sections of the golf green is changeable in use via illuminating, dimming or changing the colour of the one or more internal lighting devices.

Advantageously, lighting devices can quickly change the appearance, which allows rapid reconfiguration of the playable area. Furthermore, changing the appearance of the playable area via internal lighting devices may provide a wider range of colours and or shapes than via an external light source, for example.

In exemplary embodiments, the golf system further comprises an external lighting device, wherein the appearance of the one or more sections of the golf green is changeable in use via selectively illuminating the upper surface of the or each section of the golf green with the external lighting device.

An external lighting device (e.g. a projector) may offer a more cost effective method of changing the appearance of the one or more sections of the golf green than internal lighting devices.

According to a fifth aspect of the invention, a golf system is provided, the golf system comprising a golf green having a hole for receiving a golf ball and a golf ball tracking system configured to detect the position of a golf ball on the golf green. The golf system is configured to digitally alter the size and or shape of a playable area of the golf green and to determine whether a golf ball located on the golf green is located within the playable area or not.

According to a sixth aspect of the invention, a ball game system is provided, the ball game system comprising a reconfigurable surface having a hole intended for receiving a ball, wherein the reconfigurable surface includes a plurality of moveable sections (e.g. wherein the movable sections are provided in a reconfigurable array).

In exemplary embodiments, the ball game system is configured so that each moveable section is movable, in order to change the size or shape of a playable area of the reconfigurable surface (e.g. each moveable section is movable between a playable state and a non-playable state).

In this way, the size and or shape of the playable area of the reconfigurable surface may be altered via movement of the moveable sections. This allows a single reconfigurable surface to be used for multiple rounds of ball games, with a different configuration of the reconfigurable surface used for each round. This may be beneficial in ball game environments where space is limited (e.g. in inner city regions, or in a stadium where spectators can watch the game from a single position).

In exemplary embodiments, the plurality of movable sections defines a series of concentric rings relative to the hole.

In exemplary embodiments, the ball game system is configured to raise or lower the concentric rings to alter the diameter of the playable area of the reconfigurable surface.

In other words, the diameter of the playable area may be reduced via lowering the outermost concentric ring(s) from a playable state to a non-playable state, and the diameter of the playable area may be increased via raising one or more concentric rings from the non-playable state to the playable state.

Altering the diameter of the playable area, alters the difficulty of landing a ball on the reconfigurable surface. This allows the diameter to be reduced when a player is striking a ball from a relatively close ball start position or the diameter to be increased when a player is striking a ball from a relatively distant ball start position.

In addition, this allows the difficulty to be altered for players of different abilities. For example, the diameter could be reduced for a more experienced player, or increased for a less experienced player.

In exemplary embodiments, the ball game system further comprises a vessel configured to be filled with a liquid in use, so that an upper surface of each concentric ring is above a surface of the liquid when it is raised and below the surface of the liquid when it is lowered.

In other words, each concentric ring transitions from a playable state to a non-playable state via being submerged in the liquid held by the vessel.

Advantageously, by submerging concentric rings in their non-playable state, it is clear that they do not form part of the playable area from any viewing angle (e.g. even from a plan view).

In exemplary embodiments, the hole is a reconfigurable hole.

In exemplary embodiments, the ball game system comprises a ball start position located for striking a ball in the direction of the hole.

In exemplary embodiments, the ball game system comprises a plurality of ball start positions located for striking a ball in the direction of the hole, wherein the plurality of ball start positions are distributed at different distances from the hole.

In exemplary embodiments, the ball game system is configured to alter the diameter of the playable area of said reconfigurable surface depending on the distance between the hole and the ball start position being used.

In other words, as a player moves to a ball start position closer to the hole, the diameter of the playable area is decreased by lowering one or more concentric rings of the reconfigurable surface.

In exemplary embodiments, the ball game system is configured to alter the diameter of an adjustable aperture of said reconfigurable hole depending on the distance between the hole and the ball start position being used.

In other words, as a player moves to a ball start position closer to the hole, the diameter of an adjustable aperture of the reconfigurable hole is decreased.

In exemplary embodiments, the plurality of movable sections each comprise an upper surface, wherein the ball game system is configured such that when two or more movable sections are positioned adjacent each other, the upper surfaces of said two or more movable sections are flush.

In other words, the movable sections form a substantially planar playing area with no gaps, or a part thereof.

Advantageously, this provides a smooth surface which allows a ball to roll over without getting stuck between the movable sections.

In exemplary embodiments, the interface between adjacent concentric rings and/or the interface between an inner of the concentric rings and a centre of the reconfigurable surface comprises an overlapping arrangement.

By overlapping the edges of the concentric rings, a flush surface is provided.

In exemplary embodiments, each concentric ring comprises one or more hydraulic cylinders, wherein the ball game system is configured to raise or lower said concentric ring via extending or retracting the one or more hydraulic cylinders.

Hydraulic cylinders provide a reliable means of moving an object in a linear direction, and are therefore suitable for this application.

In exemplary embodiments, each concentric ring comprises a plurality of circumferentially distributed hydraulic cylinders.

By distributing multiple hydraulic cylinders around the concentric rings, the loads caused by the weight of the rings and any objects or people located thereon are distributed evenly around the circumference of the ring. This helps to reduce the tendency for the concentric rings to tilt, and reduces torsional or rotational pressure on the hydraulic cylinders.

In exemplary embodiments, each concentric ring is buoyant, such that, when raised in use, the load from the one or more hydraulic cylinders is complemented by an upwards pressure from the water or other suitable liquid in the vessel.

In this way, a uniformly distributed load is produced, which prevents the ring-shaped moveable section from deflecting and altering the planar nature of the playable area.

In exemplary embodiments, the ball game system further comprises a ball tracking system configured to detect the position of a ball on the reconfigurable surface.

In this way, the position of a ball relative to the hole can be detected. This may be beneficial for games which assign a points-based score depending on the proximity of a ball to the hole.

BRIEF DESCRIPTION OF THE DRAWINGS

Embodiments are now described by way of example only with reference to the accompanying drawings, in which.

DETAILED DESCRIPTION

Figure 1:
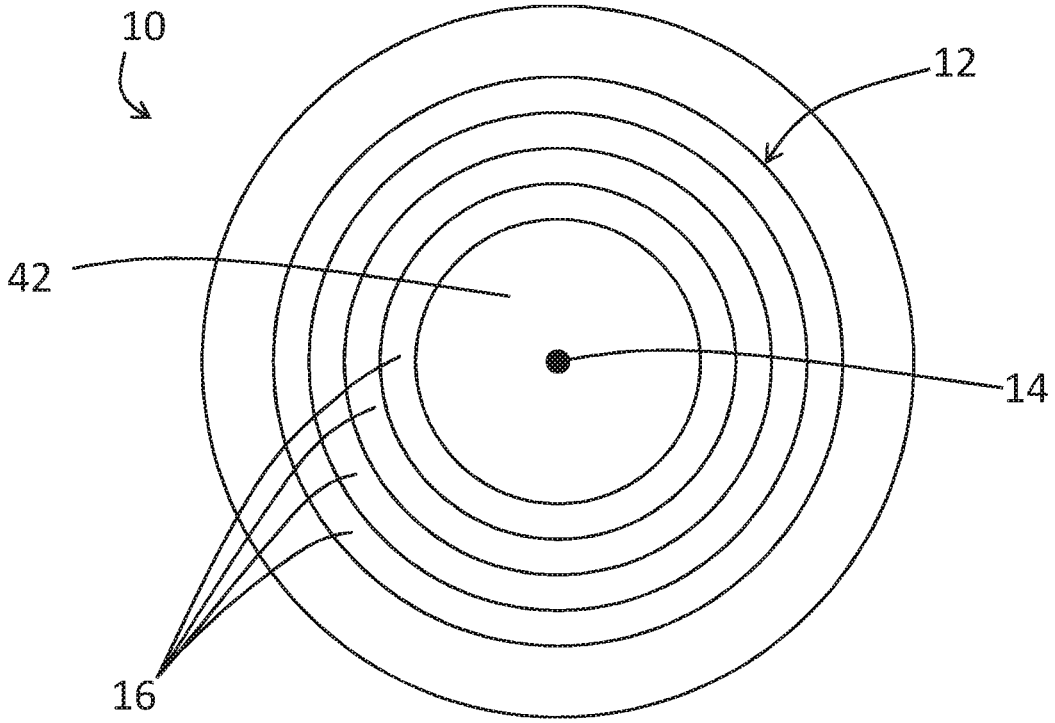
FIG. 1 is a plan view of a golf system including a reconfigurable golf green according to an embodiment.
Figure 2A:
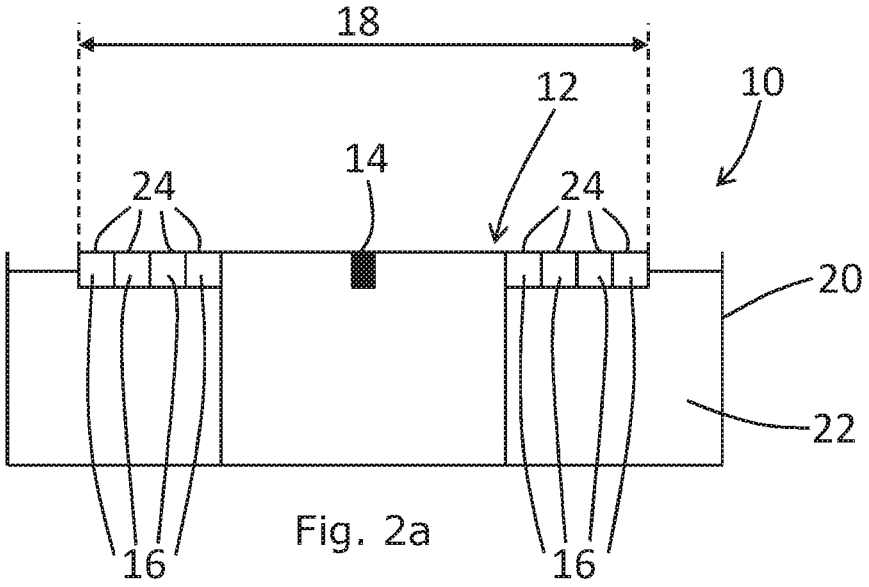
FIGS. 2*a* to 2*c* are cross-sectional views of the golf system of FIG. 1.
Figure 2B:
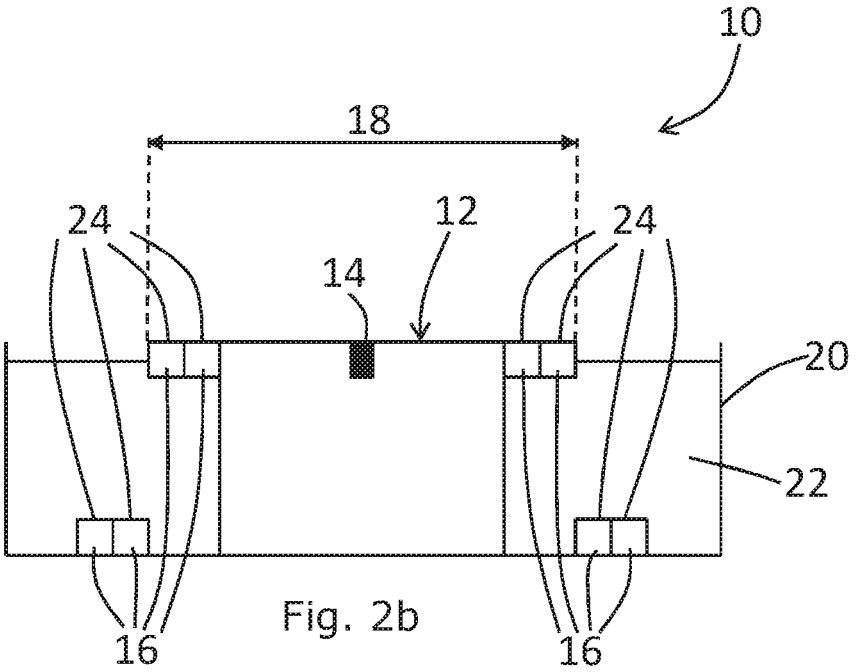
Figure 2C:
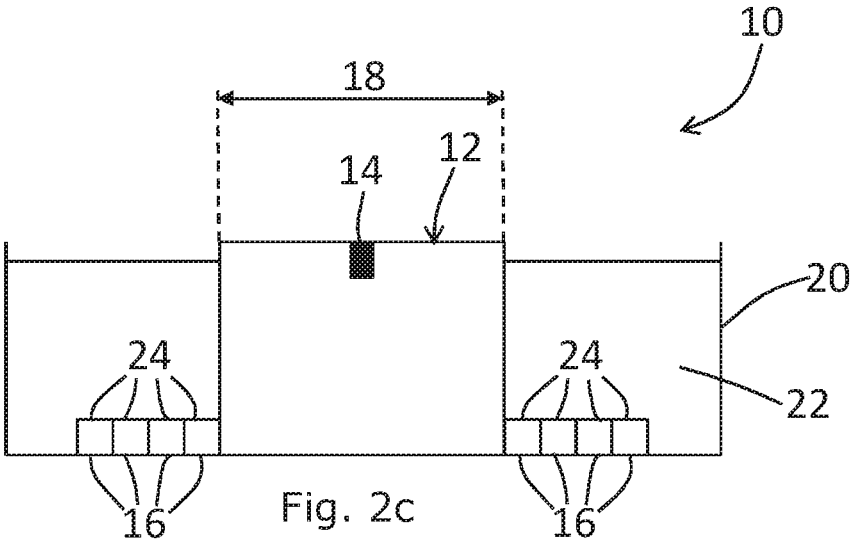

Referring to FIGS. 1 and 2*a* to 2*c*, a golf system is indicated generally at 10. The golf system 10 includes a reconfigurable golf green 12. The reconfigurable golf green 12 has a hole 14 for receiving a golf ball. As will be described in detail below, the reconfigurable golf green 12 includes a plurality of movable golf green sections 16. The movable golf green sections 16 are provided in a reconfigurable array.

The golf system 10 is configured so that each golf green section 16 is movable, in order to change the size or shape of a playable area of the golf green 12. For example, each golf green section 16 is movable between a playable state and a non-playable state. This allows a single golf green area 12 to be used for multiple rounds or 'holes' of golf, with a different configuration of the golf green 12 used for each round. This may be beneficial in golf environments where space is limited (e.g. in inner city golf courses, or in a golf stadium where spectators can watch the game from a single position).

In the illustrated embodiment, the plurality of movable golf green sections 16 defines a series of concentric rings relative to the hole 14. In alternative embodiments, the movable golf green sections 16 may be arc-shaped segments of a series of concentric rings. In yet further embodiments, the moveable golf green sections 16 may be of non-circular, polygonal or non-regular shape in plan view.

In the illustrated embodiment, the golf system 10 is configured to raise or lower the concentric rings 16 to alter the diameter 18 of the playable area of the golf green 12. In other words, the diameter 18 of the playable area may be reduced via lowering the outermost concentric ring(s) 16 from a playable state to a non-playable state (e.g. see the transition from FIGS. 2*a* to 2*b* to 2*c*). The diameter 18 of the playable area may be increased via raising one or more concentric rings 16 from the non-playable state to the playable state (e.g. see the transition from FIGS. 2*c* to 2*b* to 2*a*).

Altering the diameter 18 of the playable area alters the difficulty of landing a golf ball on the golf green 12. This allows the diameter 18 to be reduced when a player is hitting from a relatively close tee position or the diameter 18 to be increased when a player is hitting from a relatively distant tee position. In addition, this allows the difficulty to be altered for players of different abilities. For example, the diameter 18 could be reduced for a more experienced player, or increased for a less experienced player.

In alternative embodiments, the concentric rings 16 are formed from a plurality of arc-shaped segments and the golf system 10 is configured to move the segments transversely towards or away from the hole 14 to alter the diameter 18 of the playable area of the golf green 12.

In the embodiment illustrated in FIGS. 1 and 2*a* to 2*c*, the golf system 10 further includes a vessel 20 configured to be filled with a liquid 22 in use, so that an upper surface 24 of each concentric ring 16 is above a surface of the liquid 22 when it is raised and below the surface of the liquid 22 when it is lowered. In other words, each concentric ring 16 transitions from a playable state to a non-playable state via being submerged in the liquid 22 held by the vessel 20. Advantageously, by submerging concentric rings 16 in their non-playable state, it is clear that they do not form part of the playable area from any viewing angle (e.g. even from a plan view).

Figure 3A:
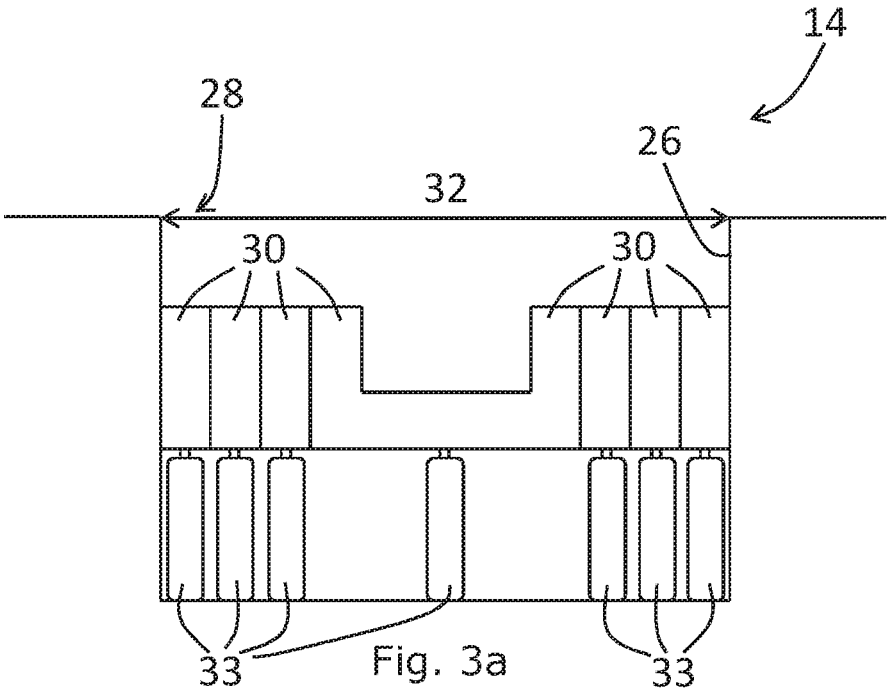
FIGS. 3*a* to 3*c* are cross-sectional views of a reconfigurable hole for receiving a golf ball according to an embodiment.
Figure 3B:
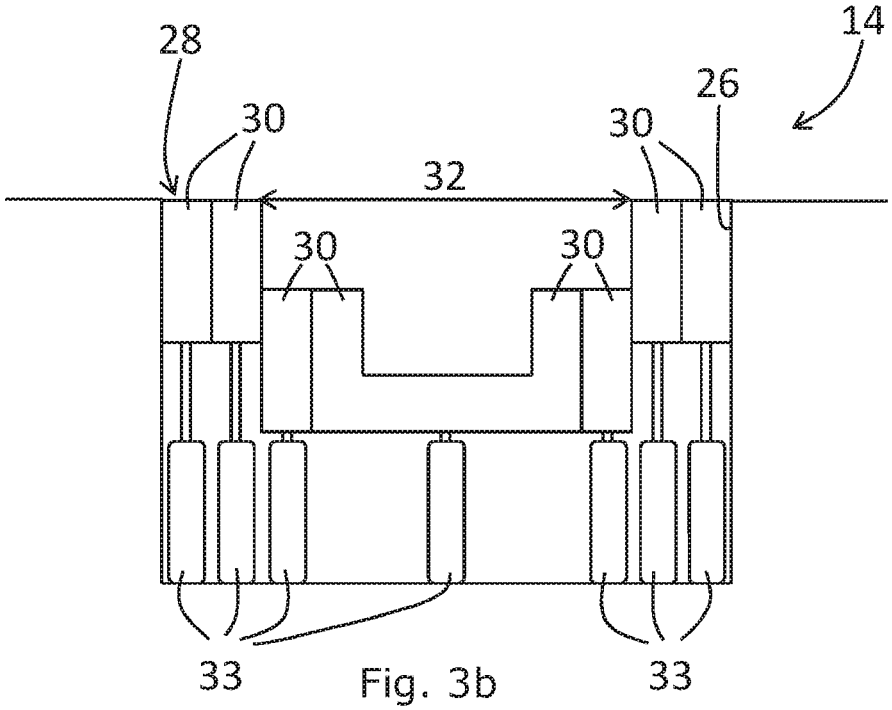

Referring to FIGS. 3*a* to 3*b*, the hole 14 of the golf system 10 in the illustrated embodiment is a reconfigurable hole. The reconfigurable hole 14 includes a cylindrical bore 26 having an upper end 28. The reconfigurable hole 14 also includes a plurality of coaxial rings 30 located within the bore 26. In other embodiments, the reconfigurable hole may include only a single coaxial ring 30 located within the bore 26.

The reconfigurable hole 14 includes an adjustable aperture at the upper end 28. The reconfigurable hole 14 is configured to alter the diameter 32 of the adjustable aperture via raising one or more coaxial rings 30 to the upper end 28 of the bore 26, or lowering one or more coaxial rings 30 into the bore 26 away from the upper end 28. In other words, the diameter 32 of the adjustable aperture is increased via lowering the outermost coaxial ring(s) 30 into the cylindrical bore 26 away from the upper end 28 (e.g. see the transition from FIGS. 3*c* to 3*b* to 3*a*). The diameter 32 of the adjustable aperture is decreased via raising one or more coaxial rings 30 to the upper end 28 of the bore 26 (e.g. see the transition from FIGS. 3*a* to 3*b* to 3*c*).

Altering the diameter 32 of the adjustable aperture alters the difficulty of hitting a golf ball through the adjustable aperture. This allows the diameter 32 to be reduced when a player is hitting from a relatively close tee position, or the diameter 32 to be increased when a player is hitting from a relatively distant tee position. In addition, this allows the difficulty to be altered for players of different abilities. For example, the diameter 32 could be reduced for a more experienced player, or increased for a less experienced player.

The reconfigurable hole 14 includes a plurality of linear actuators 33 provided to control the position of the plurality of coaxial rings 30 within the bore 26. Advantageously, linear actuators 33 provide a means of accurately controlling the position of the coaxial rings 30. Furthermore, suitable linear actuators 33 are relatively cheap and readily available.

In the illustrated embodiment, multiple linear actuators 33 are included to control a single coaxial ring 30 (e.g. the outermost linear actuators 33 are used to control the state of the outermost coaxial ring 30. In other embodiments, only one linear actuator 33 may be provided per coaxial ring 30.

In some embodiments, the reconfigurable hole 14 also includes a pole-receiving formation configured to receive a flag pole (not shown). Advantageously, this allows the hole 14 to be marked by a flag, which allows the position of the hole 14 to be identified from a greater distance.

In alternative embodiments, the golf system 10 includes a non-reconfigurable hole, rather than a reconfigurable hole 14 as described above.

Figure 3C:
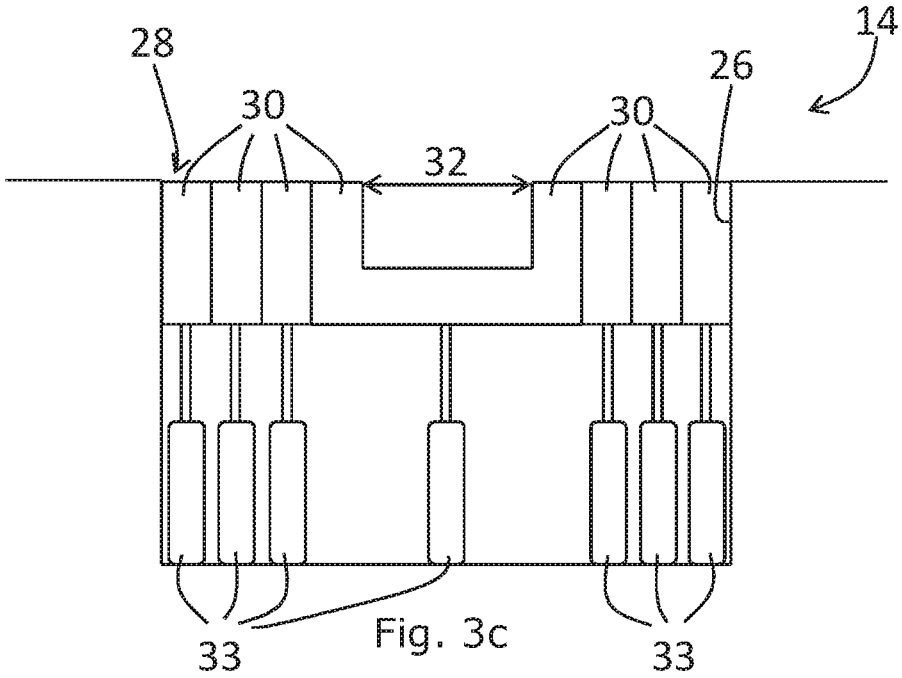

The reconfigurable hole 14 of FIGS. 3*a* to 3*c* may also be provided as a standalone system for installing in a standard golf course (e.g. in a golf course without a reconfigurable golf green).

Figure 4:
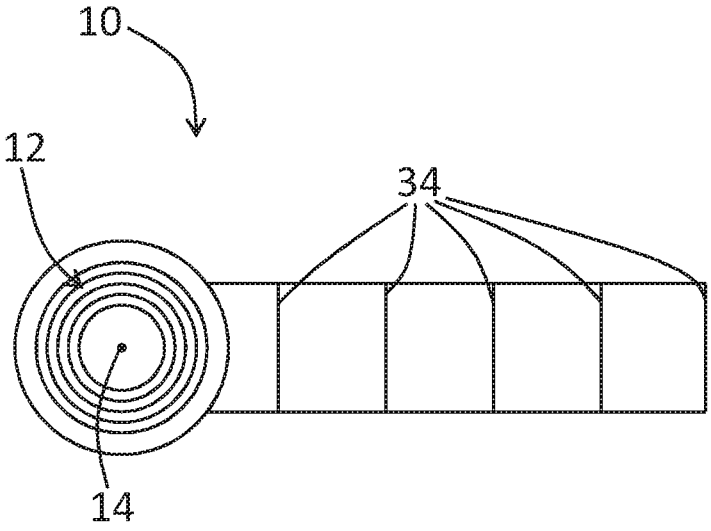
FIG. 4 is a plan view of a golf system including the reconfigurable golf green of FIGS. 1 and 2*a* to 2*c*, the reconfigurable hole of FIGS. 3*a* to 3*c* and a fairway with a plurality of tee positions, according to an embodiment.

Referring to FIG. 4, the golf system 10 further includes a plurality of tee positions 34 located for striking a ball in the direction of the hole 14. The plurality of tee positions 34 are distributed at different distances from the hole 14. In alternative embodiments, the golf system 10 may only include a single tee position 34.

In the illustrated embodiment, the golf system 10 is configured to simultaneously alter the diameter 18 of the playable area of the golf green 12 and the diameter 32 of the adjustable aperture of the reconfigurable hole 14, depending on the distance between the reconfigurable hole 14 and the tee position 34 being used. In other words, as a player moves to a tee position 34 closer to the hole 14, the diameter 18 of the playable area is decreased by lowering one or more concentric rings 16 of the reconfigurable golf green 12, and the diameter 32 of the adjustable aperture of the reconfigurable hole 14 is decreased via raising one or more coaxial rings 30 of the reconfigurable hole 14 to the upper end 28 of the cylindrical bore 26. In this way, the difficulty of hitting a golf ball into the adjustable aperture may remain substantially equal, regardless of the distance between the tee position 34 and the reconfigurable hole 14.

In alternative embodiments where the hole 14 is not a reconfigurable hole, the golf system 10 is configured to only alter the diameter 18 of the playable area of the reconfigurable golf green 12 depending on the distance between the hole 14 and the tee position 34 being used.

In alternative embodiments, the golf system 10 is configured to only alter the diameter 32 of the adjustable aperture of the reconfigurable hole 14 depending on the distance between the hole 14 and the tee position 34 being used.

Figure 5A:
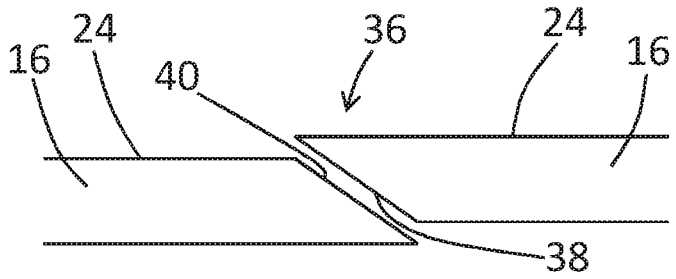
FIGS. 5*a* and 5*b* are cross-sectional views of the interface between two movable golf green sections of the golf system of FIGS. 1 and 2*a* to 2*c;*
Figure 5B:
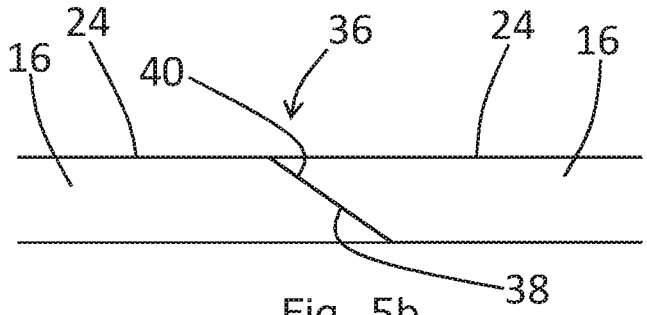

Referring to FIGS. 5*a* and 5*b*, the plurality of movable golf green sections 16 each includes an upper surface 24. As will be described in detail below, the golf system 10 is configured such that when two or more movable golf green sections 16 are positioned adjacent each other, the upper surfaces 24 of the two or more movable golf green sections 16 are flush. In other words, the movable golf green sections 16 form a substantially planar playing area with no gaps, or a part thereof. Advantageously, this provides a smooth surface which allows a golf ball to roll over without getting stuck between the movable golf green sections 16.

In the illustrated embodiment, the interface between adjacent concentric rings 16 includes an overlapping arrangement 36. By overlapping the edges of the concentric rings 16, a flush surface is provided.

The overlapping arrangement 36 includes a downwards-facing chamfered edge 38 on a radially inner side of the interface and an upwards-facing chamfered edge 40 on a radially outer side of the interface. This overlapping arrangement 36 has been found to provide a flush interface. Furthermore, this arrangement helps to self-centre the concentric rings 16, which further prevents gaps from forming.

Referring to FIG. 1, a similar chamfered overlapping arrangement 36 is provided at the interface between an inner of the concentric rings 16 and a centre 42 of the golf green 12.

In alternative embodiments, a different type of overlapping arrangement 36 may be provided. For example, the edge of each concentric ring 16 may include a resilient rim configured to pass over a resilient rim of an adjacent concentric ring 16 or centre 42 of the golf green 12.

Figure 6A:
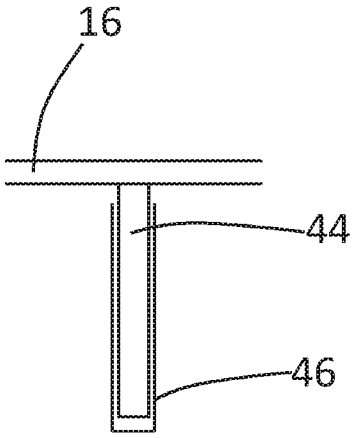
FIGS. 6*a* and 6*b* are cross-sectional views of a moveable golf green section and linear guide rod arrangement of the golf system of FIGS. 1 and 2*a* to 2*c;*
Figure 6B:
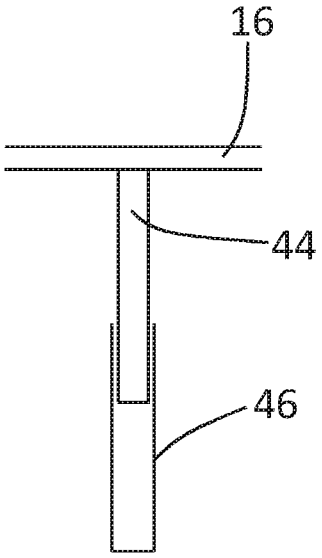

Referring to FIGS. 6*a* and 6*b*, each concentric ring 16 includes one or more linear guide rods 44 extending downwards therefrom. The golf system 10 includes one or more corresponding bosses 46 configured to receive the one or more linear guide rods 44. In this way, rotation, horizontal movement and tilting of the concentric rings 16 is prevented, whilst allowing linear vertical movement. By preventing tilting of the concentric rings 16, the chance of gaps forming in the playable area (e.g. between concentric rings 16) is reduced. By preventing rotation, any markings on the upper surface 24 of multiple concentric rings 16 (e.g. distance markings or advertising markings) do not become misaligned.

In alternative embodiments, linear guide rods may not be required (e.g. a guide channel/block arrangement described below may be sufficient to prevent misalignment in some cases).

Figure 7:
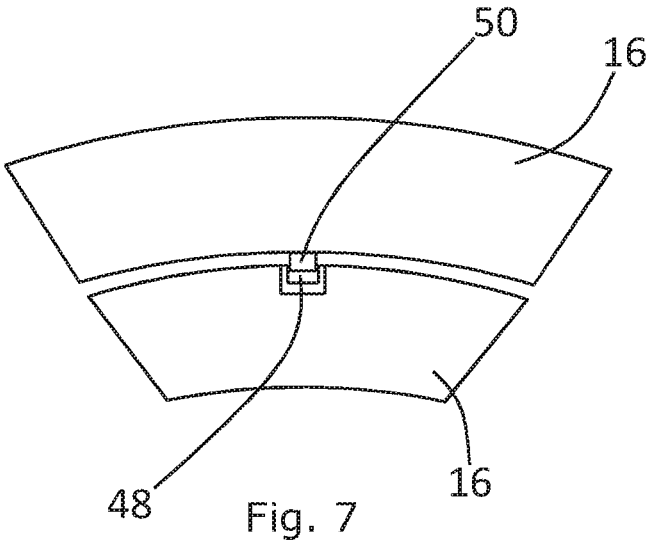
FIG. 7 is an exploded underside view of two segments of moveable golf green sections of the golf system of FIGS. 1 and 2*a* to 2*c;*

Referring to FIG. 7, the interface between adjacent concentric rings 16 includes a radially inner side having a guide channel 48 and a radially outer side having a corresponding guide block 50. The guide block 50 is arranged to move upwards and downwards through the guide channel 48.

In alternative embodiments, the radially inner side of the interface may have a guide block 50 and the radially outer side of the interface may have a corresponding guide channel.

Referring to FIG. 1, a similar guide block 50 and guide channel 48 arrangement is provided at the interface between an inner of the concentric rings 16 and the centre 42 of the golf green 12.

In this way, linear vertical movement between the concentric rings 16 and the centre 42 of the golf green 12 is permitted, but relative rotation between them is prevented. By preventing rotation, any markings on the upper surface 24 of multiple concentric rings 16 (e.g. distance markings or advertising markings) do not become misaligned.

In alternative embodiments, the guide channel/block arrangement may not be required (e.g. since the linear guide rods of FIGS. 6*a* and 6*b* may be sufficient to prevent misalignment of the concentric rings 16).

Figure 8:
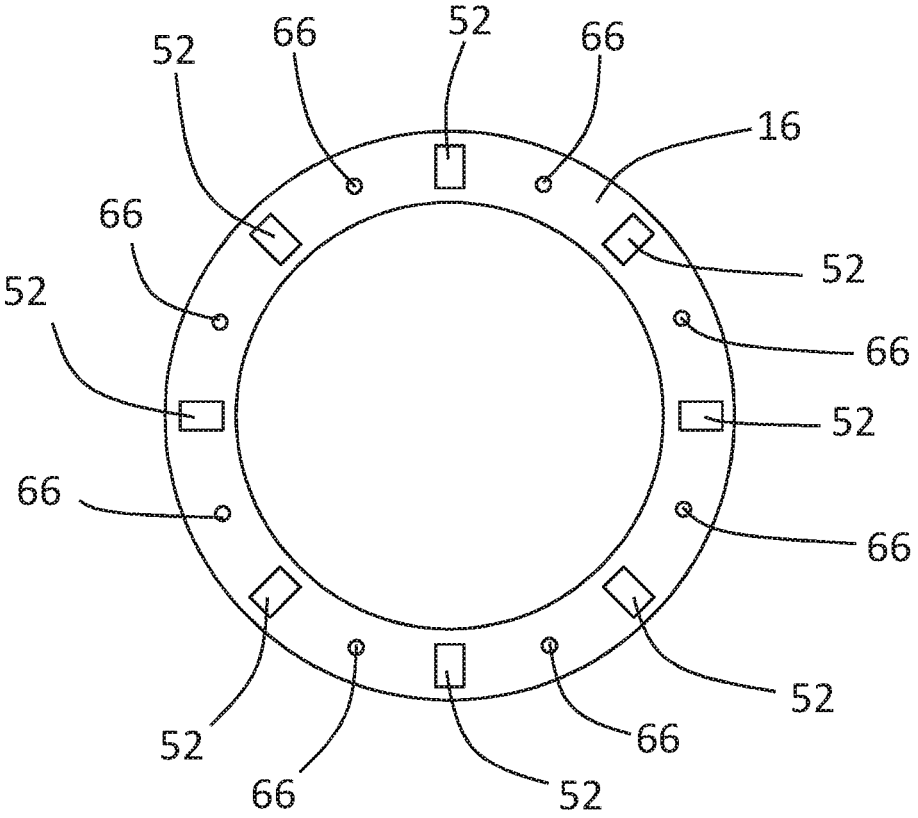
FIG. 8 is an underside view of a movable golf green section of FIGS. 1 and 2*a* to 2*c*, including a plurality of variable buoyancy devices and chain receiving arrangements, according to an embodiment.

Referring to the embodiment of FIG. 8, each concentric ring 16 includes a plurality of variable buoyancy devices 52. In this embodiment, the golf system 10 is configured to raise or lower each concentric ring 16 via altering the buoyancy of the variable buoyancy devices 52. Advantageously, the use of variable buoyancy devices 52 provides a simple system for moving the concentric rings 16 with no moving parts. This provides easy installation and maintenance.

In other embodiments only one variable buoyancy device 52 may be provided on each concentric ring 16 (e.g. a single inflatable ring-shaped tube on the underside of each concentric ring 16).

Figure 9:
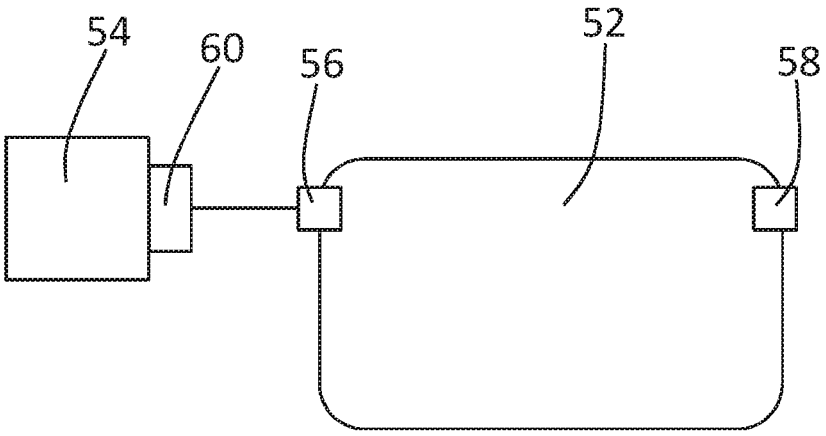
FIG. 9 is a schematic diagram of a variable buoyancy device of FIG. 8.

Referring to FIG. 9, the golf system includes a pump 54 configured to supply air or other buoyant substance to one or more variable buoyancy devices 52 of FIG. 8. A number of pump configurations may be utilised, such as: a dedicated pump 54 for each variable buoyancy device 52; a dedicated pump 54 for each concentric ring 16 (i.e. to supply air or other buoyant substance simultaneously to each variable buoyancy device 52 on the concentric ring 16); a single pump 54 for all variable buoyancy devices 52 (e.g. with flow of air or other buoyant substance to the variable buoyancy devices 52 controlled via valves 60 to selectively raise or lower a concentric ring 16); or any combination of the above.

Each variable buoyancy device 52 includes an inlet 56 for receiving air or other buoyant substance from a pump 54. In other words, the buoyancy of a variable buoyancy device 52 is increased by pumping air or other buoyant substance into the variable buoyancy device 52 through the inlet 56.

Each variable buoyancy device includes an outlet 58 for purging air or other buoyant substance from the variable buoyancy device 52. In other words, the buoyancy of the variable buoyancy device 52 is decreased via opening the outlet 58 which allows water or other liquid 22 from the vessel 20 to enter the variable buoyancy device 52 and air or other buoyant substance to flow out of the variable buoyancy device 52. In this way, the inlet 56 and pump 54 do not need to be arranged for two-way flow, since air can be purged from the outlet 58 to the surrounding water or other liquid 22 in the vessel 20.

Referring still to FIG. 9, the golf system 10 includes a valve 60 between the pump 54 and the variable buoyancy device 52. Advantageously, this provides an easy arrangement for controlling the flow of air or other buoyant substance to the variable buoyancy device 52. The number and configuration of valves 60 may vary depending on the number and configuration of pumps, as described above. For example, a single valve 60 may be provided for each pump 54 to provide on/off/proportional control of the flow of air or other buoyant substance to the variable buoyancy devices 52. Alternatively, a plurality of valves may be provided for each pump 54, to provide both on/off/proportional and/or directional control of the flow of air or other buoyant substance to the variable buoyancy devices 52.

Referring again to FIG. 8, the plurality of variable buoyancy devices 52 are circumferentially distributed around each concentric ring 16. By distributing multiple variable buoyancy devices 52 around each concentric ring 16, the loads caused by the weight of the ring 16 and any objects or people located thereon is distributed evenly around the circumference of the ring 16. This helps to reduce the tendency for the concentric rings 16 to tilt.

Figure 10:
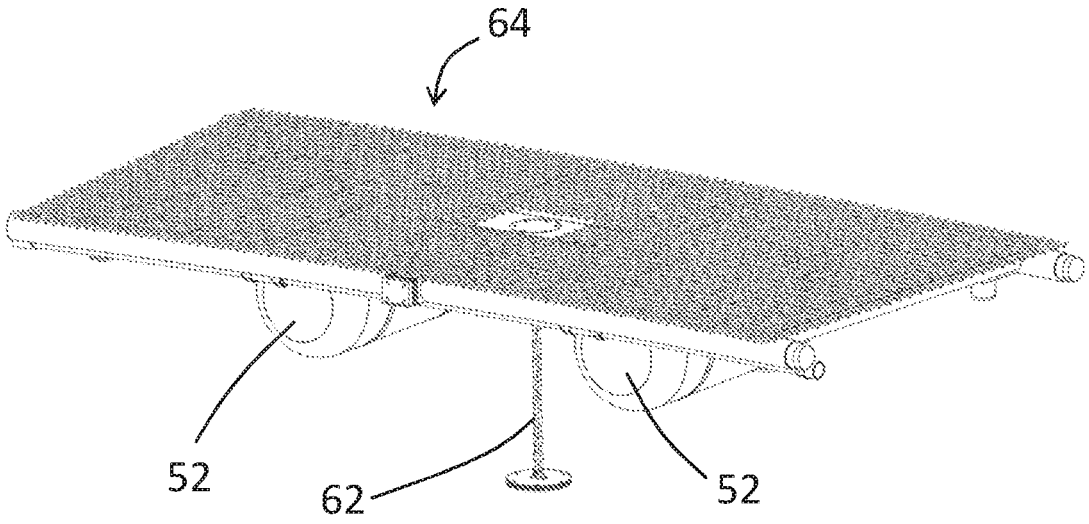
FIG. 10 is an isometric view of a segment of the movable golf green section of FIG. 8, including a height adjustment chain.

Referring to FIG. 10, each concentric ring 16 includes a height and levelling control mechanism configured to limit the extent to which it may be raised, as described in more detail below.

In the illustrated embodiment, the height and levelling control mechanism includes a plurality of chains 62 or like anchors connected to each concentric ring 16 and the vessel 20. In this way, the variable buoyancy devices 52 may be limited to raise slightly below the surface of the water or other liquid 22 in the vessel 20 so that the concentric rings 16 do not move with ripples or waves on the surface of the water or other liquid 22.

FIG. 10 only illustrates a segment 64 of a concentric ring 16, but multiple similar segments 64 may be included so that the plurality of chains 62 or like anchors are distributed circumferentially around the concentric ring 16. In alternative embodiments, the concentric rings 16 may each be a single component (e.g. not split into segments 64) and a plurality of chains 62 or like anchors may be circumferentially distributed around each ring 16. By distributing multiple chains or like anchors around the concentric rings 16, the height is limited around the circumference of the rings 16, which helps to reduce the tendency for the concentric rings 16 to tilt.

Figure 11:
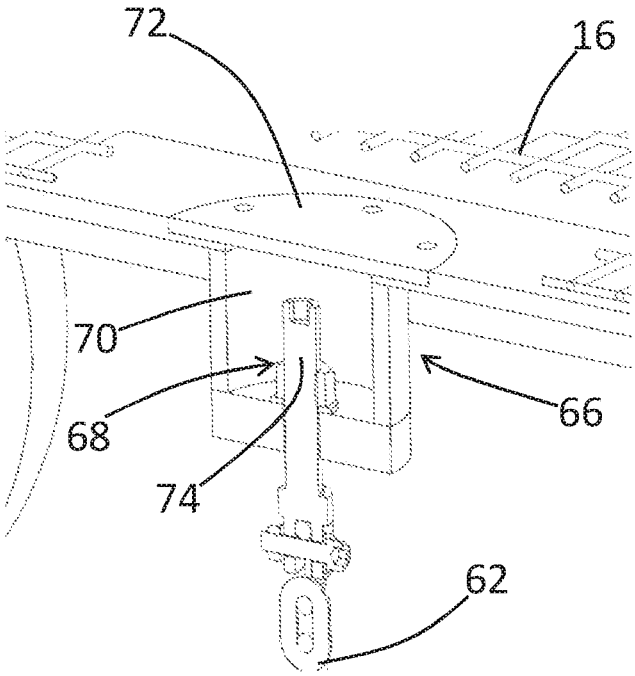
FIG. 11 is an isometric cross-sectional view of receiving arrangement and adjustment mechanism for the height adjustment chain of FIG. 10.

Referring to FIG. 11, each chain 62 or like anchor is connected to a receiving arrangement 66 on a concentric ring 16. The receiving arrangement 66 includes an adjustment mechanism 68 for altering the length of the associated chain 62 or like anchor. This provides a mechanism for adjusting and fine tuning the height/level of each concentric ring 16 during commissioning or maintenance activities.

In the illustrated embodiment, the receiving arrangement 66 includes a cavity 70 in the concentric ring 16, and a removable plate 72 arranged to cover the cavity 70. Advantageously, this provides a means of accessing the receiving arrangement 66 for adjusting the length of the chain or like anchor from above (by removing the cover plate 72) whilst maintaining a flush surface under normal operation (by covering the cavity 70 with the cover plate 72).

In the illustrated embodiment, the adjustment mechanism includes an adjustment bolt 74 located in the cylindrical cavity 70. Advantageously, a screw or bolt 74 can easily be adjusted via a hand tool such as a screwdriver, wrench or allen key.

Referring again to FIG. 8, a plurality of receiving arrangements 66 are distributed circumferentially around the concentric ring 16, for receiving a plurality of circumferentially distributed chains 62 or like anchors.

In embodiments of FIGS. 8 to 11, the variable buoyancy devices 52 are sized such that, when filled with air or other buoyant substance in use, a weight greater than the weight of the concentric rings 16 may be supported by said variable buoyancy devices 52. In this way, maintenance staff, players or other objects may be located on the concentric rings 16 without causing significant vertical movement of said concentric rings 16.

Figure 12:
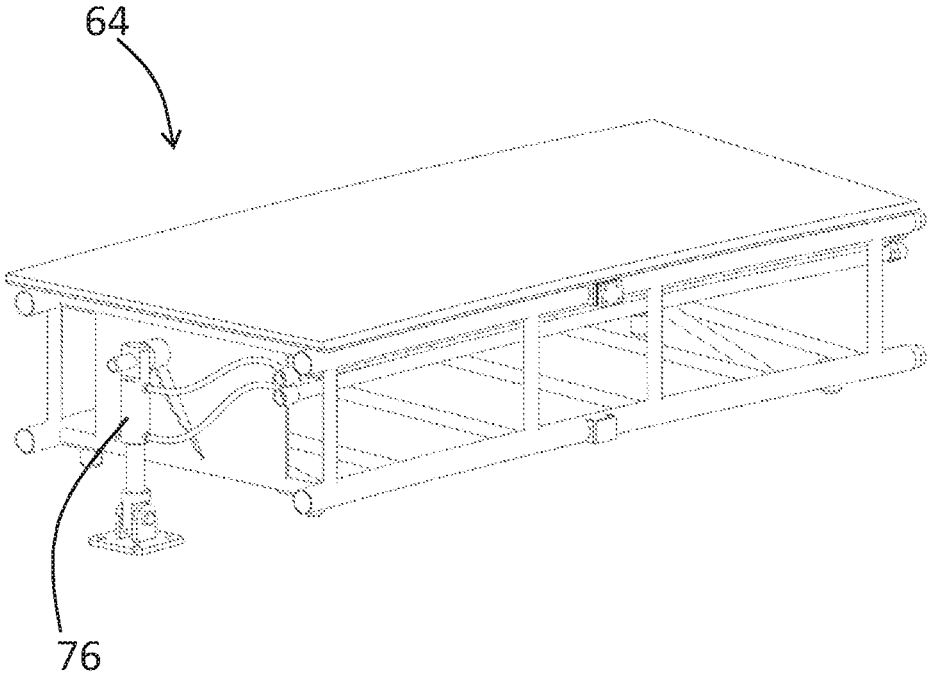
FIG. 12 is an isometric view of a segment of a movable golf green section of the golf system of FIGS. 1 and 2*a* to 2*c*, according to an alternative embodiment controlled via a hydraulic actuator.

Referring to the embodiment of FIG. 12, each concentric ring 16 includes one or more hydraulic cylinders 76 instead, or as well as, the variable buoyancy devices 52 of FIGS. 8 to 11. The illustrated embodiment depicts a single segment 64 of a concentric ring 16 with a single hydraulic cylinder 76, however, a full concentric ring 16 may include a plurality of hydraulic cylinders 76. The golf system 10 is configured to raise or lower each concentric ring 16 via extending or retracting the one or more hydraulic cylinders 76. Hydraulic cylinders 76 provide a reliable means of moving an object in a linear direction, and are therefore suitable for this application.

In embodiments where each concentric ring 16 includes a plurality of hydraulic cylinders 76, the plurality of hydraulic cylinders 76 may be circumferentially distributed around the ring 16. By distributing multiple hydraulic cylinders 76 around the concentric rings 16, the loads caused by the weight of the rings 16 and any objects or people located thereon are distributed evenly around the circumference of the ring 16. This helps to reduce the tendency for the concentric rings 16 to tilt, and reduces torsional or rotational pressure on the hydraulic cylinders 76.

In exemplary embodiments, each concentric ring 16 is buoyant, such that, when raised in use, the load from the one or more hydraulic cylinders 76 is complemented by an upwards pressure from the water or other suitable liquid 22 in the vessel 20. In this way, a uniformly distributed load is produced, which prevents the ring-shaped moveable sections 16 from deflecting and altering the planar nature of the playable area.

In some embodiments, the one or more hydraulic cylinders 76 may be oil based. In some embodiments, the one or more hydraulic cylinders 76 may be water based.

In alternative embodiments, each concentric ring 16 may be raised and lowered via one or more rotary cam mechanisms, one or more winches, or one or more rack and pinion devices (not shown).

Figure 13:
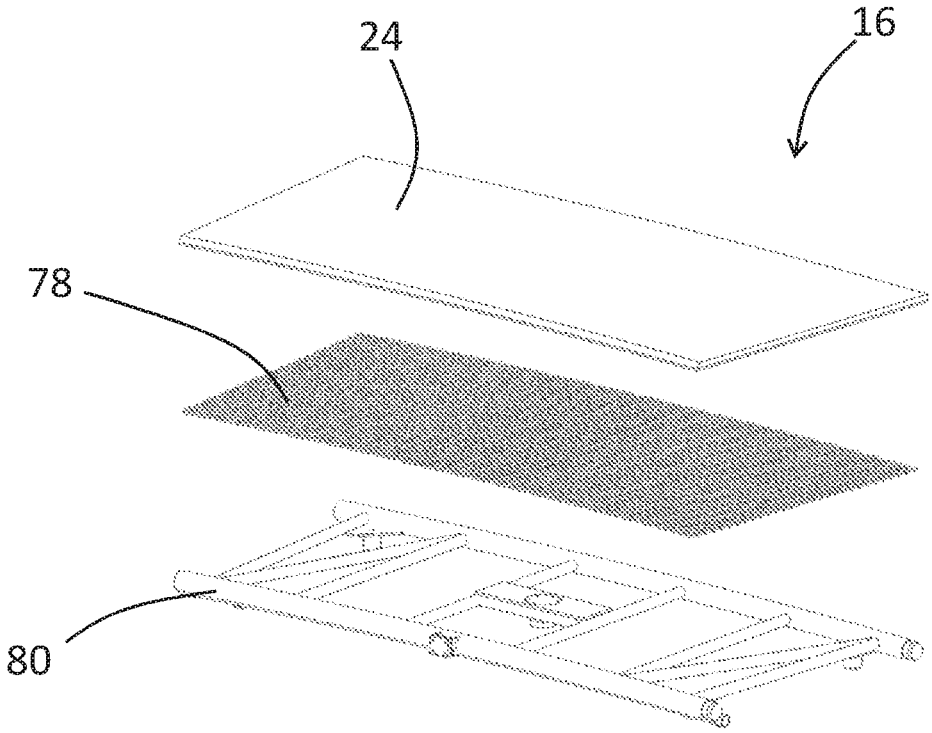
FIG. 13 is an exploded isometric view of a segment of a movable golf green section of the golf system of FIGS. 1 and 2*a* to 2*c;*

Referring to FIG. 13, each movable golf green section (i.e. concentric ring 16) is a multilayer component. The top layer is a permeable upper surface 24. The middle layer is a wire mesh 78 located below the upper surface 24. The wire mesh 78 is configured to support the upper surface 24. The bottom layer is a support frame 80 located below the wire mesh 78. The support frame 80 is configured to support the wire mesh 78 and upper surface 24.

By having a wire mesh 78 supporting a permeable upper surface 24, water or other liquid 22 does not pool on the surface 24 of the moveable golf green sections 16. This is particularly beneficial for golf systems 10 including concentric rings 16 which transition between a playable state and a unplayable state submerged under water or other liquid 22.

The thickness of each multilayer component is in the range of 50 mm to 400 mm, preferably in the range of 150 mm to 250 mm, more preferably substantially 200 mm.

In exemplary embodiments, the support frame 80 is made of a strong and lightweight material, preferably aluminium.

By having a lightweight support frame 80, relatively small sized actuators (e.g. variable buoyancy devices 52 and/or hydraulic cylinders 76 and/or winches and/or rotary cam mechanisms and/or rack and pinion devices) can be used.

In exemplary embodiments, the upper surface 24 is a layer of turf or artificial turf. Advantageously, this type of surface is readily available since it is commonly used for golf and other ball games. In addition, the properties of friction between a golf ball and a turf or artificial turf layer are well-known, which makes it suitable for defining the playable area of the golf system 10.

Figure 14:
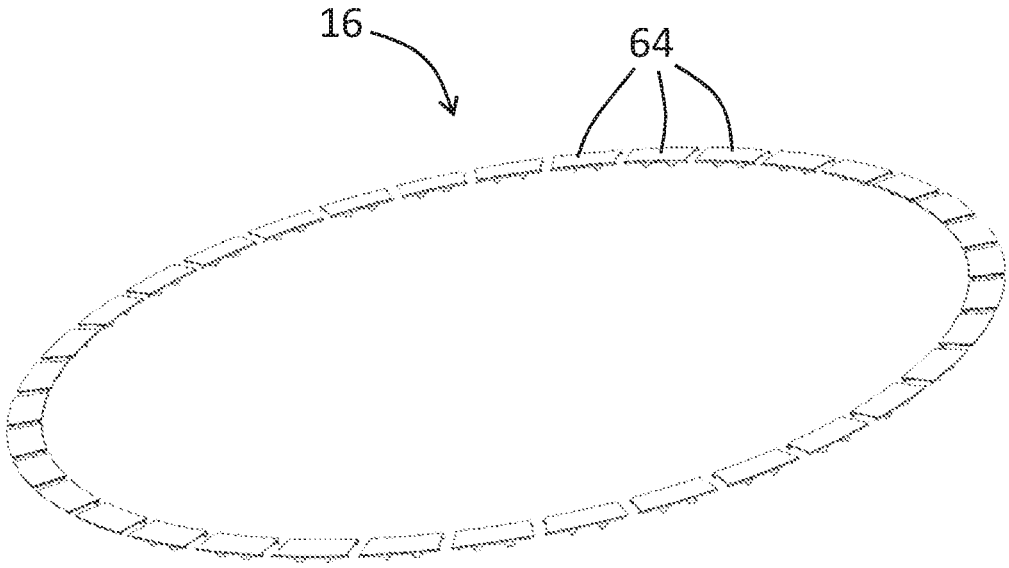
FIG. 14 is an exploded isometric view of a plurality of segments which form a movable golf green section of the golf system of FIGS. 1 and 2*a* to 2*c;*
Figure 15A:
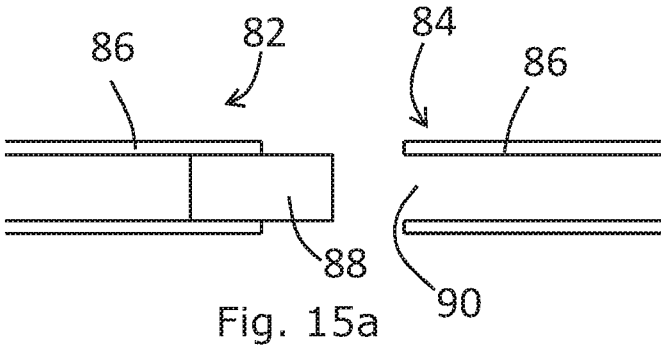
FIGS. 15*a* and 15*b* are cross-sectional views of a connection arrangement of the segments of FIG. 14.
Figure 15B:
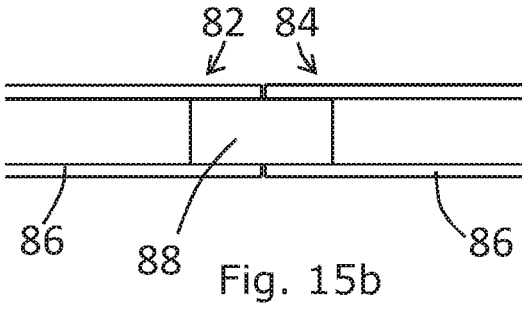

Referring to the embodiment of FIG. 14, each moveable golf green section 16 includes a plurality of segments 64. Referring to FIGS. 15*a* and 15*b*, each segment 64 includes a connection arrangement 82 for engagement with the connection arrangement 84 of another segment 64. Advantageously, this arrangement 82, 84 allows the golf system 10 to be dismantled, transported and reassembled (e.g. if part of a touring event).

In exemplary embodiments, each connection arrangement 82, 84 comprises a quick-release connection. Advantageously, this reduces the time required to assemble or dismantle the golf system 10.

In the illustrated embodiment, the connection arrangement 82, 84 is a stage truss style connection arrangement including a tubular portion 86 on each segment 64. A cylindrical block 88 is welded into one of the tubular portions 86, while the other of the tubular portions 86 has a hollow portion 90 for receiving the cylindrical block 88. To couple the segments together, the tubular portion 86 including the cylindrical block 88 is slid into the hollow portion 90 of the second tubular portion 86, as shown in FIG. 15*b*.

In the coupled state, the two tubular portions 86 may be held together by an interference fit, a snap fitting engagement (e.g. with a projecting lip around block 88 and a corresponding receiving recess in the hollow portion 90) or via a fastener such as a screw or bolt (not shown).

The illustrated embodiment shows a cross section through substantially tubular (i.e. cylindrical) portions 86 with a cylindrical block 88. In alternative embodiments, the portions 86 and block 88 may instead have a square, rectangular or other polygonal shaped cross-section.

Figure 16:
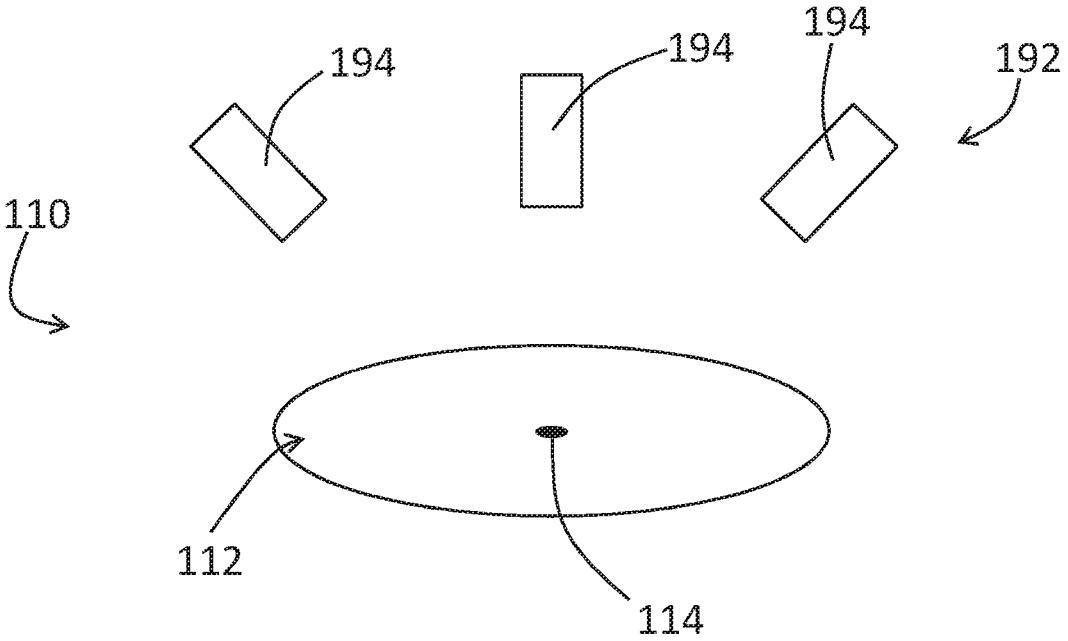
FIG. 16 is a schematic view of a golf system including a ball tracking system according to an embodiment.
Figure 17:
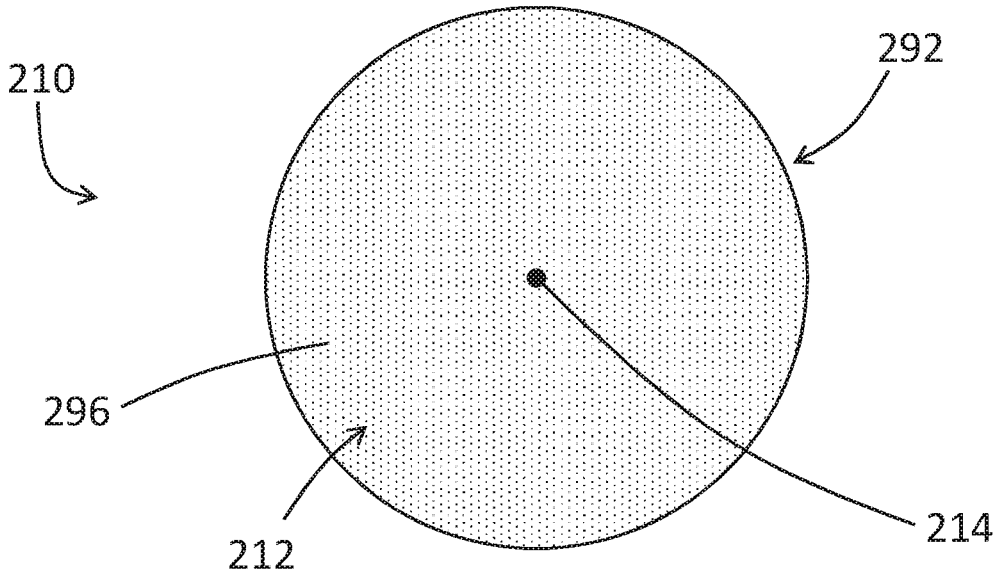
FIG. 17 is a plan view of a golf system including a ball tracking system according to a further embodiment.

Referring to FIGS. 16 and 17, the golf system 10 may also include a golf ball tracking system 192, 292 configured to detect the position of a golf ball on the golf green 112, 212. In this way, the position of a golf ball relative to the hole 114, 214 can be detected. This may be beneficial for golf games which assign a points-based score depending on the proximity of a golf ball to the hole 114, 214.

In the embodiment of FIG. 16, the golf ball tracking system 192 includes a plurality of cameras 194 configured to face the golf green 112. In other embodiments, the golf ball tracking system 192 may include only a single camera 194. Cameras have been widely used for ball tracking in a variety of sports. Therefore, this may provide a cheap and simple means of tracking a golf ball. In addition, using cameras does not require any modifications to the golf green 112 itself.

In the embodiment of FIG. 17, the golf ball tracking system 292 includes a plurality of sensors 296 (represented as dots) located within the golf green 212. This may offer a quicker means for accurately determining the position of a golf ball than other systems (e.g. camera-based systems which require a small delay due to image processing).

Either of the golf ball tracking systems 192, 292 of FIGS. 16 and 17 may also be provided in different golf systems 110, 210, which include a non-reconfigurable golf green 112, 212 having a hole 114, 214 for receiving a golf ball. Such golf systems 110, 210 may be configured to digitally alter the size and or shape of a playable area of the golf green 112, 212 and to determine whether a golf ball located on the golf green 112, 212 is located within the playable area or not.

Figure 18:
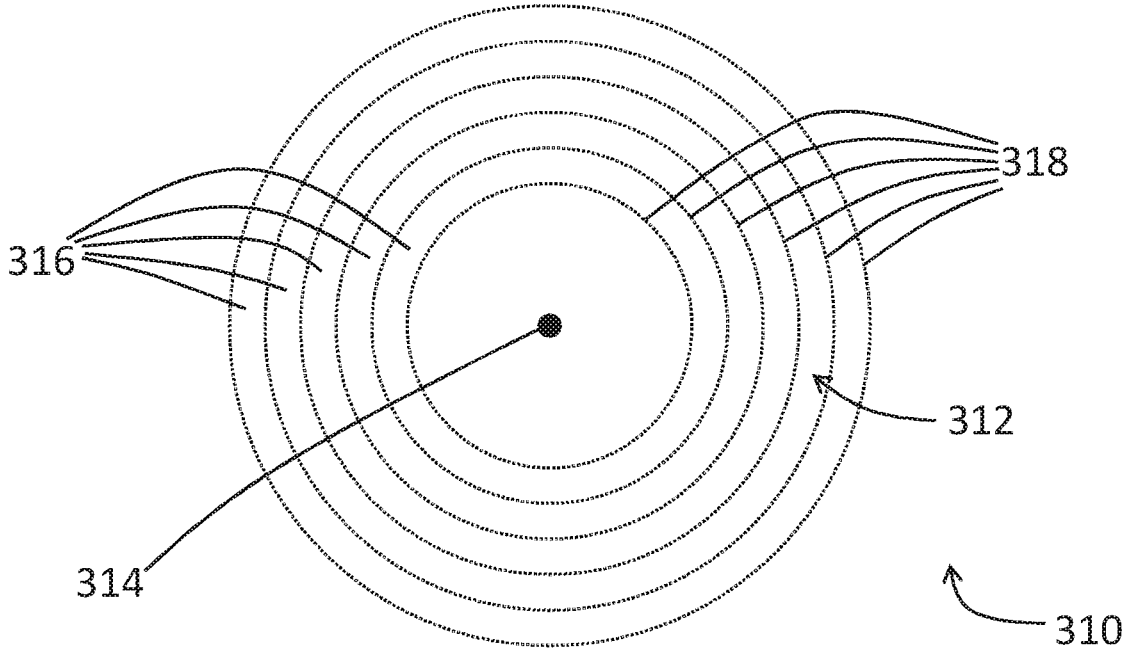
FIG. 18 is a plan view of a golf system including a reconfigurable golf green according to a further embodiment.

Referring to FIG. 18, a golf system according to a further embodiment is depicted at 310. The golf system 310 includes a reconfigurable golf green 312 having a hole 314 for receiving a golf ball. As will be described below, the size and shape of a playable area of the golf green can be automatically altered via changing the appearance of one or more sections 316 of the golf green 312. Advantageously, changing the appearance of one or more golf green sections 316 may offer a quicker mechanism for reconfiguring the playable area of the golf green than by moving sections 316 of the golf green 312. This may also provide other opportunities such displaying adverts on the playable area during breaks.

In the embodiment illustrated in FIG. 18, the golf system 310 includes a plurality of internal lighting devices 398. The appearance of the sections 316 of the golf green is changeable in use via illuminating, dimming or changing the colour of the plurality of internal lighting devices 398. Advantageously, lighting devices 398 can quickly change the appearance, which allows rapid reconfiguration of the playable area.

Figure 19:
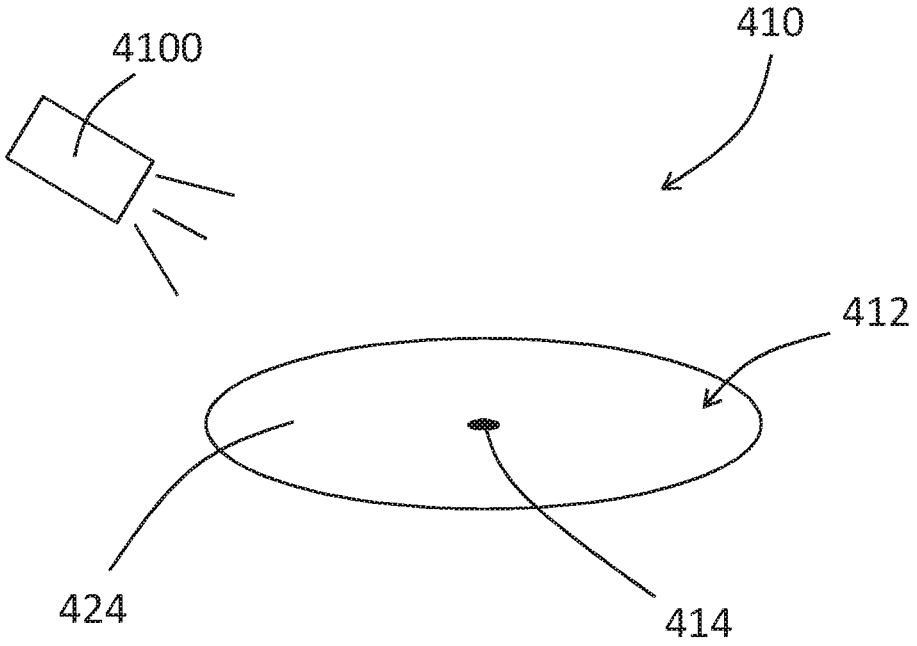
FIG. 19 is a schematic view of a golf system including a reconfigurable golf green according to a further embodiment.

Referring to FIG. 19, a golf system according to a further embodiment is depicted at 410. The golf system 410 includes a reconfigurable golf green 412 having a hole 414 for receiving a golf ball. As will be described below, the size and shape of a playable area of the golf green can be automatically altered via changing the appearance of one or more sections of the golf green 412. Advantageously, changing the appearance of one or more golf green sections may offer a quicker mechanism for reconfiguring the playable area of the golf green than by moving sections of the golf green 412. This may also provide other opportunities such displaying adverts on the playable area during breaks.

In the embodiment illustrated in FIG. 19, the golf system 410 includes an external lighting device 4100. The appearance of the one or more sections of the golf green 412 is changeable in use via selectively illuminating the upper surface 424 of the or each section of the golf green with the external lighting device 4100. An external lighting device 4100 (e.g. a projector) may offer a more cost effective method of changing the appearance of the one or more sections of the golf green 412 than internal lighting devices 398.

In the embodiments illustrated in FIGS. 1 to 19, the golf green 12, 112, 212, 312, 412 is substantially horizontal. In alternative embodiments, the golf green 12, 112, 212, 312, 412 may be tilted towards or away from the tee position(s) 34, or tilted at any other angle.

Although the invention has been described in relation to one or more embodiments, it will be appreciated that various changes or modifications can be made without departing from the scope of the invention as defined in the appended claims. For example: the golf green may be reconfigurable either physically, by appearance, or by setting an invisible boundary and tracking the position of a golf ball to determine whether it falls within the invisible boundary or not; the system may be a ball game system having a reconfigurable surface with a hole for receiving any type of sports ball (e.g. a soccer ball or a baseball); multiple holes may be provided (e.g. holes of different sizes, representing a range of difficulties); any number of tee positions may be provided (e.g. 10 tee positions at different distances from the hole); the hole may be part of a moveable section of the golf green or a fixed section of the golf green; the golf green may be substantially circular or may be another regular or irregular shape; any type of levelling system may be used to ensure the concentric rings are correctly aligned; and any suitable type of connection arrangement may be provided between segments of the concentric rings.

The invention claimed is:

1. A golf system comprising a reconfigurable golf green having a center and a hole disposed in the center for receiving a golf ball, wherein the reconfigurable golf green includes a plurality of discrete movable golf green sections, wherein the golf system is configured so that each golf green section is movable, in order to change the size or shape of a playable area of the golf green, wherein the golf system is configured to raise or lower the golf green sections to alter the size of the playable area of the golf green, and wherein each of the discrete moveable golf green sections defines a ring or an arcuate portion thereof, wherein said ring or arcuate portion thereof is concentric with the hole, the golf system further comprising a vessel with an outer rim, wherein an upper surface of each golf green section is level with or above the outer rim when it is raised and below the outer rim when it is lowered.

2. A golf system according to claim 1, wherein the plurality of movable golf green sections defines a series of concentric rings relative to the hole.

3. A golf system according to claim 2, wherein the golf system is configured to raise or lower the concentric rings to alter the diameter of the playable area of the golf green.

4. A golf system according to claim 1, wherein the hole is a reconfigurable hole.

5. A golf system according to claim 4, wherein the reconfigurable hole comprises:

a cylindrical bore having an upper end;

one or more coaxial rings located within said bore; and an adjustable aperture at said upper end;

wherein the reconfigurable hole is configured to alter the diameter of said adjustable aperture via raising one or more coaxial rings to the upper end of the bore, or lowering one or more coaxial rings into the bore away from the upper end.

6. A golf system according to claim 1, wherein the golf system comprises a plurality of tee positions located for striking a ball in the direction of the hole, wherein the plurality of tee positions are distributed at different distances from the hole.

7. A golf system according to claim 1, wherein the plurality of movable golf green sections each comprise an upper surface and wherein the golf system is configured such that when two or more movable golf green sections are positioned adjacent each other, the upper surfaces of said two or more movable golf green sections are flush.

8. A golf system according to claim 7, wherein an interface between adjacent golf green sections and/or an interface between an inner of the golf green sections and the center of the golf green comprises an overlapping arrangement.

9. A golf system according to claim 8, wherein the overlapping arrangement comprises a downwards-facing chamfered edge on a radially inner side of the interface and an upwards-facing chamfered edge on a radially outer side of the interface.

10. A golf system according to claim 1, wherein each golf green section comprises one or more hydraulic cylinders, and wherein the golf system is configured to raise or lower said golf green sections via extending or retracting the one or more hydraulic cylinders.

11. A golf system according to claim 10, wherein the plurality of movable golf green sections defines a series of concentric rings relative to the hole, and wherein each concentric ring comprises a plurality of circumferentially distributed hydraulic cylinders.

12. A golf system according to claim 1, wherein each moveable golf green section comprises a plurality of segments, wherein each segment comprises a connection arrangement for engagement with the connection arrangement of another segment.

13. A golf system according to claim 1, further comprising a golf ball tracking system configured to detect the position of a golf ball on the golf green.

14. A golf system according to claim 1, wherein the center of the golf green comprises an upper surface, wherein each golf green section is moveable between a playable state in which an upper surface of said golf green section is contiguous with the upper surface of the center and a non-playable state in which the upper surface of said golf green section is isolated from the upper surface of the center.

15. A golf system according to claim 1, wherein the vessel is configured to be filled with a liquid in use.

16. A method of operating a golf green with the golf system of claim 1, the method comprising:

defining the playable area of the golf green with the plurality of discrete moveable golf green sections; and selectively moving one or more of the discrete golf green sections between a raised position and a lowered position in order to alter the size of the playable area.

17. A method according to claim 16, wherein each discrete movable golf green section has an upper surface, and wherein the plurality of discrete movable golf green sections are cooperable so that the upper surface of a first of said plurality of discrete movable golf sections is contiguous with the upper surface of at least one other of said plurality of discrete moveable golf green sections.

18. A golf system comprising a reconfigurable golf green having a center and a hole disposed in the center for receiving a golf ball, wherein the reconfigurable golf green includes a plurality of discrete movable golf green sections, wherein the golf system is configured so that each golf green section is movable, in order to change the size or shape of a playable area of the golf green, wherein the golf system is configured to raise or lower the golf green sections to alter the size of the playable area of the golf green, wherein each of the discrete moveable golf green sections defines a ring or an arcuate portion thereof, wherein said ring or arcuate portion thereof is concentric with the hole, and wherein each golf green section comprises one or more hydraulic cylinders, and wherein the golf system is configured to raise or lower said golf green sections via extending or retracting the one or more hydraulic cylinders, the golf system further comprising a vessel configured to be filled with a liquid in use, so that an upper surface of each golf green section is above a surface of the liquid when it is raised and below the surface of the liquid when it is lowered, wherein each golf green section is buoyant, such that, when raised in use, the load from the one or more hydraulic cylinders is complemented by an upwards pressure from the liquid in the vessel.

19. A reconfigurable golf hole for receiving a golf ball comprising:

a cylindrical bore having an upper end;

one or more discrete coaxial rings located within said bore; and an adjustable aperture at said upper end;

wherein the reconfigurable hole is configured to alter the diameter of said adjustable aperture via raising one or more coaxial rings to the upper end of the bore, or lowering one or more coaxial rings into the bore away from the upper end, and wherein the reconfigurable golf hole further comprises one or more linear actuators provided within the cylindrical bore to control the position of the one or more coaxial rings within the bore.

* * * * *